US009983515B2

(12) United States Patent
Matsuduki et al.

(10) Patent No.: US 9,983,515 B2
(45) Date of Patent: May 29, 2018

(54) ROTATION-INFORMATION DETECTING DEVICE, ROTATION CONTROL DEVICE, AND IMAGE FORMING APPARATUS

(71) Applicant: FUJI XEROX CO., LTD., Tokyo (JP)

(72) Inventors: Masato Matsuduki, Kanagawa (JP); Osamu Shimizu, Kanagawa (JP); Takashi Saeki, Kanagawa (JP); Teruki Kishimoto, Kanagawa (JP); Shinji Kawashima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days. days.

(21) Appl. No.: 15/226,050

(22) Filed: Aug. 2, 2016

(65) Prior Publication Data

US 2017/0277082 A1 Sep. 28, 2017

(30) Foreign Application Priority Data

Mar. 24, 2016 (JP) ..... 2016-060776

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS

2005/0168187 A1* 8/2005 Uchiyama ..... G01P 3/486 318/772
2006/0184258 A1* 8/2006 Matsuda ..... G03G 15/0131 700/56
2011/0085827 A1* 4/2011 Tominaga ..... G03G 15/043 399/301
2014/0035496 A1* 2/2014 Mizuo ..... H02P 23/005 318/400.17
2014/0270852 A1* 9/2014 Doshida ..... G03G 15/1615 399/167
2015/0280627 A1* 10/2015 Okumura ..... H02P 8/08 399/167
2017/0052483 A1* 2/2017 Takahashi ..... G03G 15/161

FOREIGN PATENT DOCUMENTS

JP 6-324062 A 11/1994
JP 2000-188889 A 7/2000
JP 2007-248954 A 9/2007

* cited by examiner

*Primary Examiner* — Francis Gray
(74) *Attorney, Agent, or Firm* — Sughrue Mion, PLLC

(57) ABSTRACT

A rotation-information detecting device including: a rotatable rotary member having plural detection target portions arranged at predetermined intervals over an entire circumference of the rotary member; two detectors that are fixedly arranged at two positions of the rotary member in a rotating direction, and can detect the detection target portions; and a computation unit that computes rotation information of the rotary member based on detection information, wherein the two detectors are arranged along the circumferential direction of the rotary member at an interval of an angle of $\pi/N$, and wherein the computation unit includes an offset calculating section that offsets an eccentric error of the rotary member based on outputs of the two detectors at a current time point and n outputs at time points back from the current time point by phases of $(n\pi)/N$, to calculate a true rotational error.

18 Claims, 13 Drawing Sheets

N: INTEGER EQUAL TO OR GREATER THAN 2
n:1~N-1

ROTATION-INFORMATION DETECTING DEVICE, ROTATION CONTROL DEVICE, AND IMAGE FORMING APPARATUS

CROSS-REFERENCE TO RELATED APPLICATIONS

This application is based on and claims priority under 35 USC 119 from Japanese Patent Application No. 2016-060776 filed Mar. 24, 2016.

BACKGROUND

Technical Field

The present invention relates to a rotation-information detecting device, a rotation control device, and an image forming apparatus.

SUMMARY

According to an aspect of the invention, there is provided a rotation-information detecting device including:

a rotatable rotary member that has plural detection target portions arranged at predetermined intervals over an entire circumference of the rotary member in a circumferential direction;

two detectors that are fixedly arranged at two positions of the rotary member in a rotating direction of the detection target portions, and can detect the detection target portions that are rotating; and a computation unit that computes rotation information of the rotary member based on detection information from the two detectors, wherein N is an integer equal to or greater than 2, and n is an integer of 1 to (N−1), wherein the two detectors are arranged along the circumferential direction of the rotary member at an interval of an angle of $\pi/N$, and wherein the computation unit includes an offset calculating section that offsets an eccentric error of the rotary member based on outputs of the two detectors at a current time point and n outputs at time points back from the current time point by phases of $(n\pi)/N$, to calculate a true rotational error.

BRIEF DESCRIPTION OF THE DRAWINGS

Exemplary embodiments of the present invention will be described in detail based on the following figures, wherein.

DETAILED DESCRIPTION

Overview of Exemplary Embodiment

Figure 1:
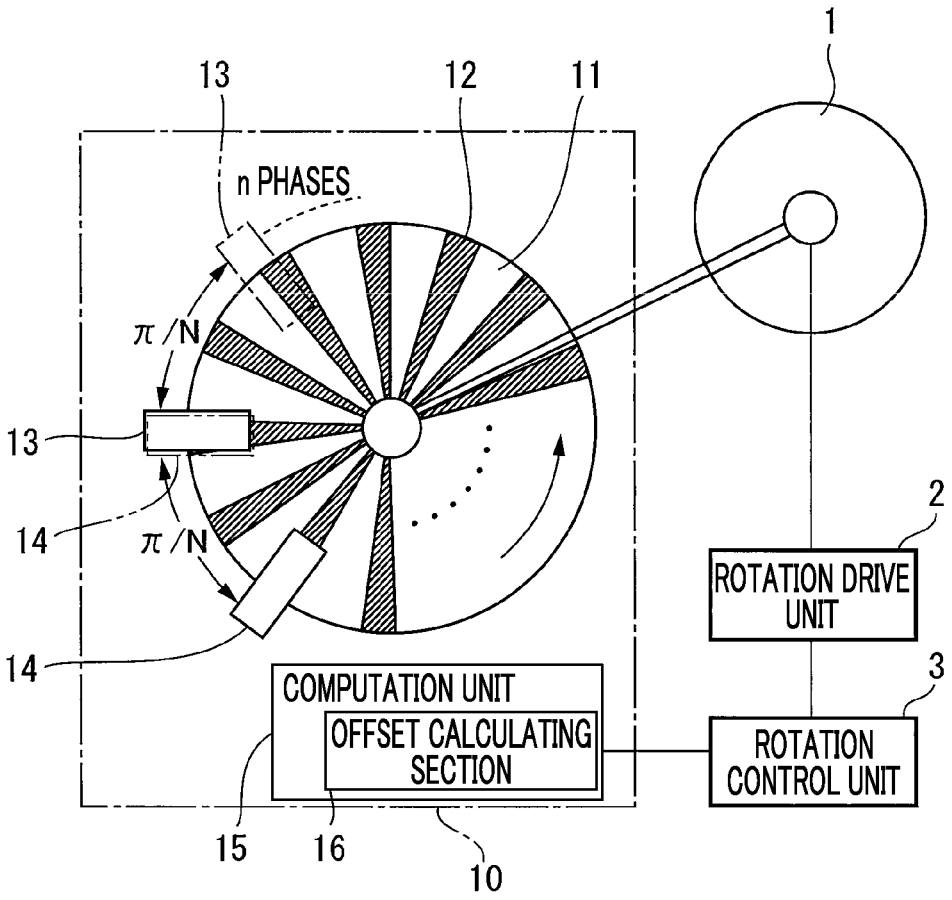
FIG. 1 is an illustrative diagram showing an overview of an exemplary embodiment and showing an aspect of a rotation control device.

FIG. 1 is an illustrative diagram showing an overview of an exemplary embodiment and showing an aspect of a rotation control device. In FIG. 1, the rotation control device of the present example includes a rotatable rotary body 1, a rotation drive unit 2 that drives rotation of the rotary body 1, a rotation-information detecting device 10 that detects rotation information of the rotary body 1, and a rotation control unit 3 that controls the rotation drive unit 2 so as to reduce a corresponding true rotational error based on a true rotational error calculated from the rotation-information detecting device 10.

In addition, the rotation-information detecting device 10 includes a rotatable rotary member 11 that has plural detection target portions 12 arranged at predetermined intervals over an entire circumference of the rotary member in a circumferential direction, two detectors 13 and 14 that are fixedly arranged at two positions along a rotating direction of the detection target portions 12 of the rotary member 11 and can detect the detection target portions 12 which are rotating, and a computation unit 15 that computes rotation information of the rotary member 11 based on detection information from the two detectors 13 and 14. When N is an integer of 2 or greater, and n is an integer of 1 to N−1, the two detectors 13 and 14 are arranged along the circumferential direction of the rotary member 11 at an interval of an angle of $\pi/N$, and the computation unit 15 includes an offset calculating section 16 that offsets an eccentric error of the rotary member 11 based on outputs of the two detectors 13 and 14 at a current time point and n outputs at time points back from the current time point by phases of $(n\pi)/N$, to calculate a true rotational error.

When the rotation information of the rotary body 1 is detected by the rotation-information detecting device 10, the rotary shaft of the rotary body 1 is to be coincident with the rotational center of the rotary member 11 and the rotary body and the rotary member rotate; however, it is difficult for the rotary shaft to be coincident with the rotation center, and it is assumed that the rotary member 11 eccentrically rotates. Therefore, in order to detect a rotational error of the rotary body 1 as the rotation information of the rotary body 1, there is a need to remove an eccentric component of the rotary member 11, and the computation unit 15, more specifically, the offset calculating section 16 is to perform such calculation.

Here, there is no particular limitation to a method of detecting rotation information by using the detection target portions 12 and the detectors 13 and 14, and examples of the method include various methods such as a method in which optical slits are used as the detection target portions 12 and the detectors 13 and 14 detect passing light through the slits, a method in which optical reflective surfaces are used as the detection target portions 12 and the detectors 13 and 14 detect reflected light, a method in which magnetic poles by a magnet are used as the detection target portions 12 and Hall elements are used as the detectors 13 and 14, and a method in which an uneven surface is used as the detection target portions 12 and displacement sensors are used as the detectors 13 and 14. In addition, the detection target portions 12 may be formed on either the circumferential surface side of the rotary member 11 or the surface side intersecting with the circumferential surface. Further, as long as the two detectors 13 and 14 are arranged at an interval of an angle of $\pi/N$, there is no limitation to an angle formed between the two detectors.

Next, exemplary embodiments of the rotation-information detecting device 10 will be described.

From a viewpoint of the detection of the true rotational error of the rotary body 1, of the two detectors 13 and 14, the detector 13 disposed on the upstream side in the rotating direction of the rotary member 11 in a range where an angle formed between the two detectors 13 and 14 is equal to or less than $\pi/2$ is referred to as the upstream-side detector 13, and the detector 14 disposed on the downstream side is referred to as the downstream-side detector 14. Then, it is preferable that the offset calculating section 16 calculates the true rotational error as a value obtained by dividing, by 2, a sum of a total obtained by adding outputs of the upstream-side detector 13 and the downstream-side detector 14 at the current time point and a total of n differences obtained by subtracting outputs of the upstream-side detector 13 from outputs of the downstream-side detector 14 at time points back from the current time point by phases of $(n\pi)/N$.

In addition, from a viewpoint of simplification of a configuration of the rotation-information detecting device 10, it is preferable that the two detectors 13 and 14 are arranged so as to have an angle of $\pi/2$ or $\pi/3$ therebetween. In this case, the number of computations in the computation unit 15 is reduced to be low.

Further, application of the rotation control device to an image forming apparatus may be performed as follows. In other words, the image forming apparatus includes a toner holding member that holds a toner image and rotates, an image forming unit that forms a toner image on the toner holding member, and a rotation control device that controls the rotation of the toner holding member. The rotation control device described above may be used as the rotation control device.

Here, the toner holding member may have a roll shape or a belt shape, and examples thereof include a belt-shaped photoconductor, an intermediate transfer belt, and the like. A representative embodiment of the image forming apparatus in a case of the belt-shaped toner holding member, it is preferable that the toner holding member includes plural tension rolls that rotate by being supported on a support member, and an endless belt member that is stretched over the plural tension rolls and is capable of being pulled out from the plural tension rolls in a direction of a rotary shaft of the corresponding tension roll, that a rotation control device controls the rotation of at least one of the plural tension rolls, and that the rotation control device may be one described above. Further, it is preferable that the two detectors 13 and 14 are arranged at positions at which the detectors do not interfere with a pulling-out operation of the endless belt member.

As a layout, in which the rotation-information detecting device 10 of this example is suitably disposed, the following embodiment is provided. In other words, the image forming apparatus includes an image forming unit that forms a toner image, a plural tension rolls that rotate by being supported on a support member, an endless belt member that is stretched over the plural tension rolls and is capable of being pulled out from the plural tension rolls in a direction of a rotary shaft of the corresponding tension roll, and a rotation-information detecting device 10 that is attached to a rotary shaft of at least one the plural tension rolls and detects rotation information of the rotary shaft. The rotation-information detecting device 10 includes a rotatable rotary member 11 that has the plural detection target portions arranged at predetermined intervals over the entire circumference of the rotary member in the circumferential direction, and two detectors 13 and 14 that are fixedly arranged at two positions along a rotating direction of the detection target portions 12 of the rotary member 11, and can detect the detection target portions 12 that are rotating. The two detectors 13 and 14 have an angle of $\pi/2$ or smaller therebetween and are arranged at positions at which the detectors do not interfere with the pulling-out operation of the endless belt member.

Hereinafter, the invention will be described further in detail based on the exemplary embodiments shown in the accompanying drawings.

Exemplary Embodiment 1

Figure 2:
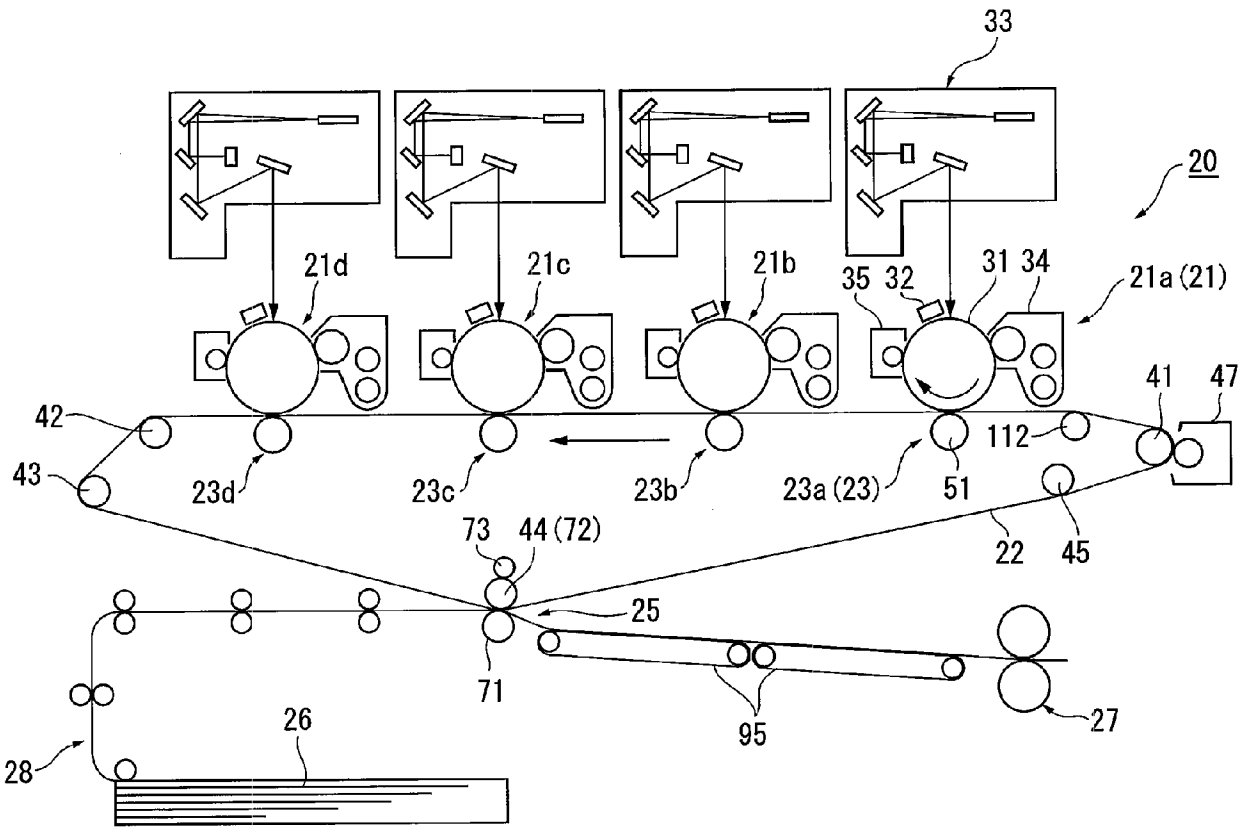
FIG. 2 is an illustrative diagram showing an entire configuration of an image forming apparatus according to Exemplary Embodiment 1.

FIG. 2 is an illustrative diagram showing an entire configuration of the image forming apparatus according to Exemplary Embodiment 1.

In FIG. 2, an image forming apparatus 20 is a so-called tandem type intermediate transfer type, in which image forming units 21 (specifically 21*a* to 21*d*), which forms a plural color images (in this example, yellow, magenta, cyan, and black), are arranged along a substantially horizontal transverse direction, an endless intermediate transfer belt 22 is provided to be rotatable in a loop at a portion facing the image forming units 21, primary transfer devices 23 (specifically, 23*a* to 23*d*: in this example, primary transfer rolls 51 are applied thereto), which primarily transfers color toner images formed in the image forming units 21 to the intermediate transfer belt 22, are provided on a rear surface of the intermediate transfer belt 22 corresponding to the image forming units 21, and a secondary transfer device 25, which secondarily transfers (collectively transfers), to a recording material 26, the color toner images subjected to the primary transfer to the corresponding intermediate transfer belt 22, is disposed in a part of the intermediate transfer belt 22 positioned on the downstream side of the image forming units 21 (in this example, 21*d*) which is positioned on the most downstream side in a moving direction of the intermediate transfer belt 22. In addition, the image forming apparatus 20 of this example includes a fixing device 27 that fixes, to the recording material 26, the toner image subjected to the collective transfer in the secondary transfer device 25, and a recording material transport system 28 that transports the recording material 26 to a zone of transferring by the secondary transfer device 25 and to a zone of fixing by the fixing device 27.

In the exemplary embodiment, each of the image forming units 21 (21*a* to 21*d*) includes a drum-shaped photoconductor 31, and, around the photoconductor 31, is provided with a charging device 32 that charges the photoconductor 31, an exposure device 33 that exposes the photoconductor such that an electrostatic latent image is formed on the charged photoconductor 31, a developing device 34 that develops the electrostatic latent image formed on the photoconductor 31 with color toners, and a cleaning device 35 that removes toner remaining on the photoconductor 31.

In addition, the intermediate transfer belt 22 is stretched over the plural (five in the exemplary embodiment) tension rolls 41 to 45, which are rotatably supported by a support member (not shown), in which the tension roll 41 is used as a drive roll which is driven by a drive motor (not shown), and the tension rolls 42 to 45 are used as driven rolls. In addition, the tension roll 44 is used as a facing roll of the secondary transfer device 25. Further, a cleaning device 47 for removing toner remaining on the intermediate transfer belt 22 after the secondary transfer is provided on the front surface side of the intermediate transfer belt 22 facing the tension roll 41.

The secondary transfer device 25 of this example has a secondary transfer roll 71 which is disposed to be in contact with the front surface of the intermediate transfer belt 22 corresponding to the tension roll 44, and the tension roll 44 at a position facing the secondary transfer roll 71 with the intermediate transfer belt 22 nipped therebetween is caused to function as a backup roll 72. Further, a power feeding roll 73 is disposed to be in contact with a front surface of the backup roll 72 and a secondary transfer electric field is caused to be formed between the power feeding roll 73 and the secondary transfer roll 71. Note that reference number 95 in the drawings represents a transport belt that transports the recording material 26 after the secondary transfer toward the fixing device 27, and reference number 112 represents a positioning roll that positions the intermediate transfer belt 22 to be described below.

Figure 3A:
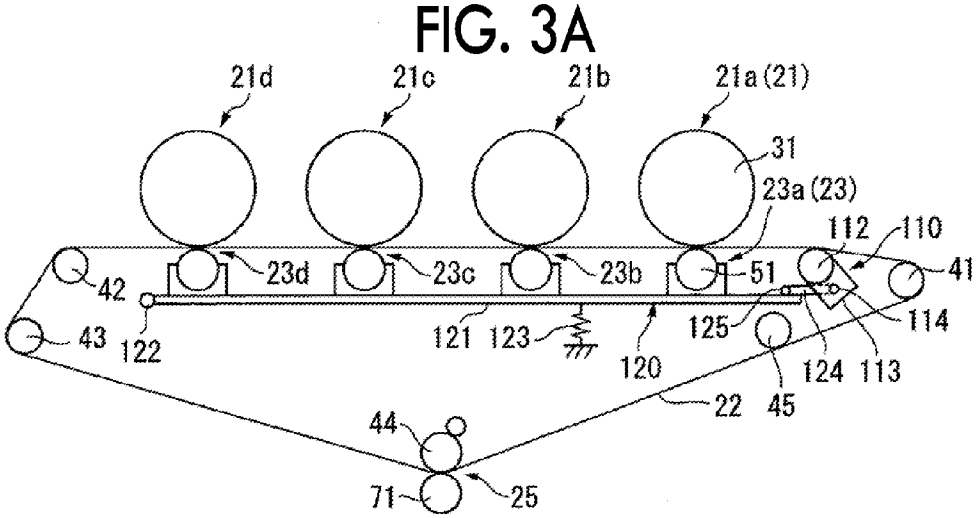
FIGS. 3A and 3B are illustrative diagrams showing a contact/separation mechanism for contact and separation of an intermediate transfer belt between a photoconductor and the mechanism and an interlocking mechanism that is interlocked with the contact/separation mechanism in Exemplary Embodiment 1.
Figure 3B:
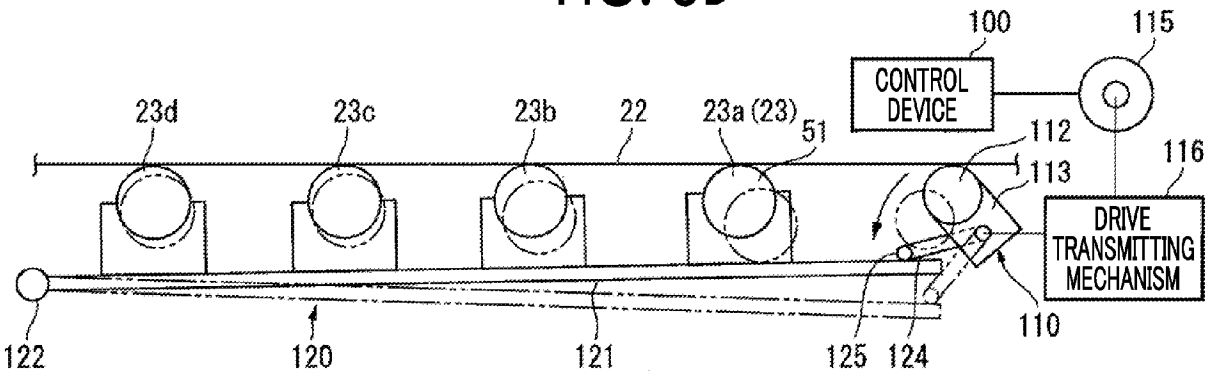

Further, in the exemplary embodiment, as shown in FIGS. 3A and 3B, in order to exchange the intermediate transfer belt 22, a contact/separation mechanism 110 for causing the intermediate transfer belt 22 to come into contact with or to be separated from the photoconductor 31, and an interlocking mechanism 120 that is interlocked with the contact/separation mechanism. The contact/separation mechanism 110 has a configuration in which, with respect to the tension roll 42 which is set in advance to be fixed at a position on a movement track of the intermediate transfer belt 22 on the rear surface of the intermediate transfer belt 22 positioned between the image forming units 21*c* and 21*d*, the positioning roll 112 set to be able to change as a movement regulation position of the intermediate transfer belt 22 is disposed on the rear surface of the intermediate transfer belt 22 positioned on the upstream side of the image forming unit 21*a* positioned on the most upstream side in the moving direction of the intermediate transfer belt 22, and the positioning roll 112 is supported by an oscillation base 113 which can oscillate about an oscillation fulcrum 114.

In addition, as shown in FIG. 3B, a drive system of the contact/separation mechanism 110 includes a drive motor 115 that start driving in response to a control signal from a control device 100, and drive force from the drive motor 115 is to be transmitted to the oscillation fulcrum 114 of the oscillation base 113 via a drive transmitting mechanism 116 configured with a gear, belt, and/or the like. It is needless to say that the control device 100 of this example also performs various types of control related to image forming.

The interlocking mechanism 120 is interlocked with the contact/separation mechanism 110 such that the primary transfer devices 23 (23*a* to 23*c*) corresponding to the image forming units 21 (21*a* to 21*c*) come into contact with and are separated from the intermediate transfer belt 22. The interlocking mechanism 120 has an oscillation plate 121 which can oscillate about an oscillation fulcrum 122 within the intermediate transfer belt 22, the oscillation fulcrum 122 described above is set at a portion corresponding to a position on the downstream side of the image forming unit 21*d*, and the primary transfer devices 23*a* to 23*c* are fixedly set on the oscillation plate 121. A bias spring 123 biases the oscillation plate 121 toward the intermediate transfer belt 22 side. Further, a rotary member 124 that rotates in response to the oscillation of the oscillation base 113 is provided on the oscillation fulcrum 114 of the oscillation base 113 of the contact/separation mechanism 110, a hanging piece 125 is provided in a portion separated from the oscillation fulcrum 114 of the rotary member 124, and the hanging piece 125 is to be hung on an oscillation free end of the oscillation plate 121.

The contact/separation mechanism 110 and the interlocking mechanism 120 cause the intermediate transfer belt 22 to recede from the photoconductors 31 of the image forming units 21*a* to 21*d*, and cause the primary transfer rolls 51 of the primary transfer devices 23 corresponding to the image forming units 21*a* to 21*d* to recede to a position at which the primary transfer roll is not in contact with the intermediate transfer belt 22.

In the configuration having the contact/separation mechanism 110 and the interlocking mechanism 120, in a case where the intermediate transfer belt 22 is disposed to be in contact with the photoconductors 31 of all of the image forming units 21 (21*a* to 21*d*), as shown in FIG. 3B, the positioning roll 112 of the contact/separation mechanism 110 may be advanced to an advance position shown in a solid line. At this time, the intermediate transfer belt 22 is positioned by the tension roll 42 and the positioning roll 112, the photoconductors 31 of the image forming units 21 (21*a* to 21*d*) and the intermediate transfer belt 22 are disposed to be in contact with each other, and the primary transfer rolls 51 of the primary transfer devices 23 (23*a* to 23*d*) corresponding to the image forming units 21 (21*a* to 21*d*) are also disposed to be in contact with the intermediate transfer belt 22.

By comparison, in a case where, for example, in order to exchange the intermediate transfer belt 22, the intermediate transfer belt 22 is disposed not to be in contact with the photoconductors 31 of the image forming units 21, the positioning roll 112 of the contact/separation mechanism 110 may recede to a recession position shown in a two-dot chain line. At this time, the intermediate transfer belt 22 is positioned by the tension roll 42 and the tension roll 41, the photoconductors 31 of the image forming units 21 (21*a* to 21*d*) and the intermediate transfer belt 22 are disposed not to be in contact with each other, and the intermediate transfer belt 22 and the positioning roll 112 receding to the recession position are disposed not to be in contact with each other.

Further, the rotary member 124 of the interlocking mechanism 120 moves to a position shown in a two-dot chain line, in response to the recession of the positioning roll 112 to the recession position, thereby oscillating the oscillation plate 121 about the oscillation fulcrum 122 via the hanging piece 125 and pushing down the oscillation plate. In this manner, the primary transfer devices 23 (in this example, 23*a* to 23*d*) provided on the oscillation plate 121 are disposed not to be in contact with the intermediate transfer belt 22. At this time, the intermediate transfer belt 22 is loosened with the recession of the positioning roll 112. It is needless to say that, although not shown in the drawing, the secondary transfer roll 71 is configured to be able to recede, along with the interlocking mechanism 120, from the intermediate transfer belt 22.

Figure 4:
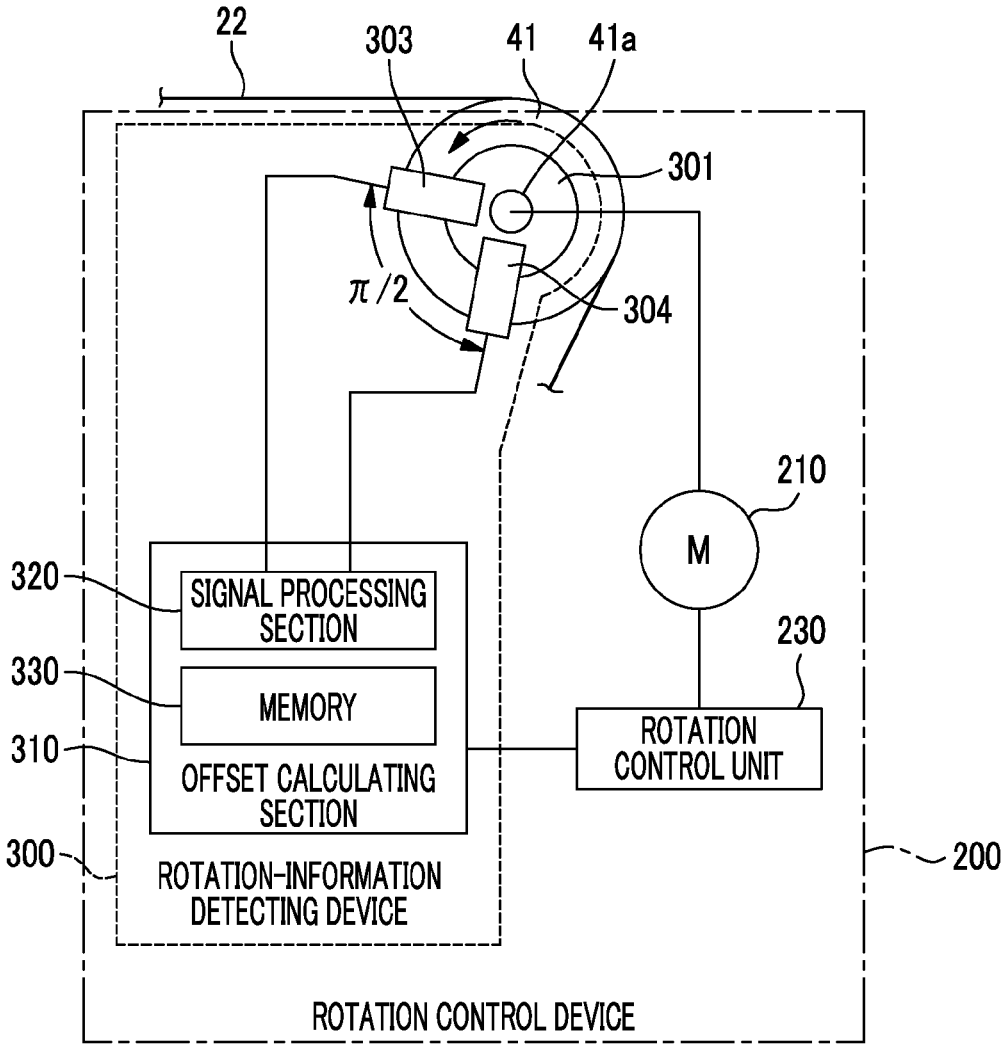
FIG. 4 is an illustrative diagram showing a rotation control device of Exemplary Embodiment 1.

In the exemplary embodiment, a rotation control device 200 is provided with respect to the tension roll 41 so as to decrease a rotational error of the corresponding tension roll 41. FIG. 4 is an illustrative diagram showing the rotation control device 200 of the exemplary embodiment. Rotation of the tension roll 41 is controlled, and thereby rotation of the intermediate transfer belt 22 is controlled.

In FIG. 4, the rotation control device 200 is configured to include the tension roll 41 as a rotatable rotary body (acquiring a rotational state of the intermediate transfer belt 22 at the tension roll 41), a drive motor 210 as a rotation drive unit that drives rotation of the tension roll 41, a rotation-information detecting device 300 that detects rotation information of the tension roll 41 and then calculates a true rotational error, and a rotation control unit 230 that controls the drive motor 210 so as to decrease the true rotational error based on the true rotational error calculated by the rotation-information detecting device 300.

In addition, the rotation-information detecting device 300 includes an encoder disc 301 as a rotatable rotary member that has optical slits (not shown) as plural detection target portions arranged at predetermined intervals over the entire circumference of the rotary member in the circumferential direction, two detectors 303 and 304 that are fixedly arranged at two positions along a rotating direction of the optical slits of the encoder disc 301 and can detect the optical slits which are rotating, and an offset calculating section 310 that calculates a true rotational error of the encoder disc 301 based on the detection information from the detectors 303 and 304.

Here, the encoder disc 301 is configured to be attached to a rotary shaft 41*a* of the tension roll 41, for example, via coupling and to be able to rotate along with the rotation of the tension roll 41. In addition, the two detectors 303 and 304 are arranged at positions (90-degree phase) so as to have an angle of π/2 (90 degrees) therebetween, and the detectors 303 and 304 are arranged inside a boundary of a circular track of the intermediate transfer belt 22 when viewed in an axial direction of the tension roll 41. As the detectors 303 and 304 of the exemplary embodiment, a photo-interrupter is used, and portions of a light-emitting element and a light-receiving element are arranged to interpose the encoder disc 301 therebetween. In this manner, light from the light-emitting element is received through the optical slit along with the rotation of the encoder disc 301. In this example, an upstream-side detector disposed on the upstream side of the encoder disc 301 in the rotating direction in a portion in which an angle between the two detectors 303 and 304 is π/2 with respect to the rotating direction of the tension roll 41 is detector 303, and a downstream-side detector is the detector 304.

Meanwhile, the offset calculating section 310 causes the light emitting elements of the two detectors 303 and 304 to emit light, receives an output signal from the light-receiving element, and includes a signal processing section 320 that performs various types of processing on the output signal, a memory 330 that primarily stores the output signal input to the signal processing section 320, or the like. Information from the offset calculating section 310 is transmitted to the rotation control unit 230 such that the drive motor 210 is controlled. In this example, the offset calculating section 310 and the rotation control unit 230 are provided in the rotation control device 200; however, it is needless to say that the offset calculating section and the rotation control unit may be provided in the control device 100 shown in FIG. 3B.

Next, processing in the offset calculating section 310 will be described.

In the offset calculating section 310, an eccentric error of the encoder disc 301 is offset from outputs (current amount) of the two detectors 303 and 304 at the current time point, and outputs (past amount) at time points back from the current time point by phases of π/2 such that the true rotational error is calculated. Specifically, the true rotational error is to be calculated as a value obtained by dividing, by 2, a sum of a total obtained by adding the outputs (current amount) of the detector 303 and the detector 304 at the current time point, and differences obtained by subtracting an output (past amount) of the detector 303 from an output (past amount) of the detector 304 at a time point back from the current time point by a phase of π/2.

This calculation method is further described with reference to FIGS. 5A and 5B. Here, FIG. 5A is a schematic view showing a positional relationship between the encoder disc 301 and the detectors 303 and 304, and FIG. 5B is a block diagram showing an error calculating method in the offset calculating section 310.

Figure 5A:
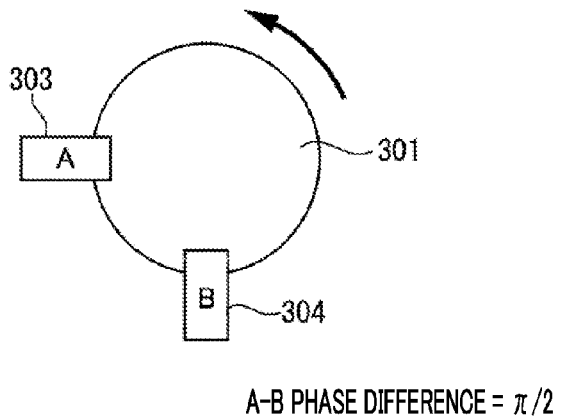
FIG. 5A is a schematic view showing a positional relationship between an encoder disc and a detector in Exemplary Embodiment 1.
Figure 5B:
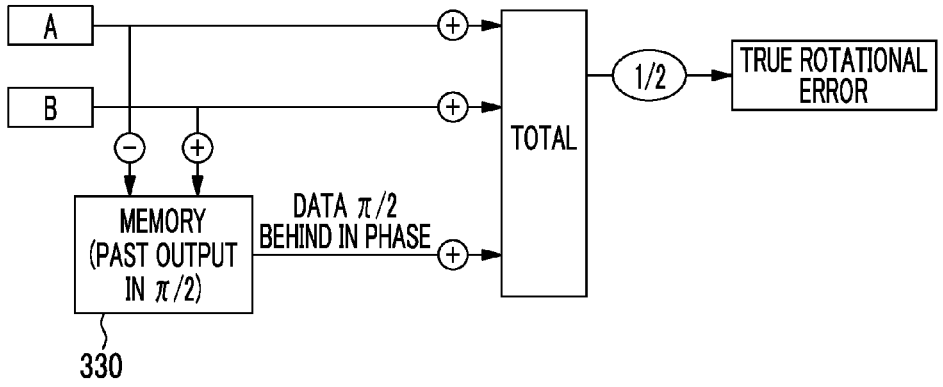
FIG. 5B is a block diagram showing an error calculating method in an offset calculating section.

In FIGS. 5A and 5B, the offset calculating section 310 of the exemplary embodiment performs computation as shown in the block diagram, using the current output and the past output shifted by π/2, which is stored in the memory 330, with respect to the output from the detector 303 side (A-phase output), and the output from the detector 304 side (B-phase output). In other words, a sum of a difference obtained by subtracting the A-phase output from the B-phase output in the past output shifted by π/2 and a total of current A-phase output and B-phase output is obtained, and then the true rotational error is calculated by dividing the obtained sum by 2. This is understood with the following expressions.

Here, when

A(t): A-phase output

B(t): B-phase output tc: current time point tp: time point π/2 (90 degrees) behind in phase ω: angular velocity e(t): true error, $$A(tc)=e(tc)+\sin(\omega tc) \quad (1)$$

$$B(tc)=e(tc)+\sin(\omega tc-\pi/2) \quad (2)$$

$$A(\mathrm{tp})=e(\mathrm{tp})+\sin(\omega \mathrm{tp}) \quad (3)$$

$$B(\mathrm{tp})=e(\mathrm{tp})+\sin(\omega \mathrm{tp}-\pi/2) \quad (4).$$

Here, $$\mathrm{tp}=tc-\pi/(2\omega) \quad (5)$$

When sin in the expressions (3) and (4) is substituted with the expression (5), $$A(\mathrm{tp})=e(\mathrm{tp})+\sin(\omega tc-\pi/2) \quad (6)$$

$$B(\mathrm{tp})=e(\mathrm{tp})+\sin(\omega tc-\pi)=e(\mathrm{tp})-\sin(\omega tc) \quad (7).$$

Here, when the expressions (1), (2), (6), and (7) are added or subtracted as in the block diagram in FIG. 5B, the following result is obtained.

$$\{A(tc)+B(tc)-A(tp)+B(tp)\}/2 = \{e(tc)+\sin(\omega tc)+e(tc)+\sin(\omega tc-\pi/2)-e(tp)-\sin(\omega tc-\pi/2)+e(tp)-\sin(\omega tc)\}/2 = e(tc)$$

As a result, an error (e(tp)) at a time point tp is also offset, and only the true error at the current time point tc is calculated.

Normally, in order to improve rotation accuracy of the rotary body such as the tension roll 41, a method, in which the rotation accuracy of the rotary body is detected using a rotary encoder, then feedback to the control of the drive motor 210 is performed. At this time, in a case of using only one detector, when there is an eccentric error in attachment of the encoder disc 301, an error component is generated with respect to measurement of one cycle of the rotary body, and thus it is not possible to obtain exact rotation accuracy of the rotary body. Therefore, from the related art, a method, in which the two detectors 303 and 304 are attached with a phase difference of 180 degrees (facing arrangement) with respect to the encoder disc 301, and outputs of both the detectors are averaged, and thereby an eccentric component of the encoder disc 301 is removed, has been known.

However, as shown in Comparative embodiment to be described below, it is difficult to arrange the two detectors 303 and 304 accurately with a phase difference of 180 degrees, and, in this case, it is difficult to detect the true rotational error by simply averaging the outputs of both the detectors.

In the exemplary embodiment, as described above, after the true rotational error, from which the eccentric component is removed, is calculated, the rotation of the tension roll 41 is more accurately controlled, thereby making it possible to more accurately forming an image on the intermediate transfer belt 22.

Further, in the exemplary embodiment, it is possible to arrange the two detectors 303 and 304 within a boundary of the circular track of the intermediate transfer belt 22 when viewed in the axial direction of the tension roll 41, and, when the intermediate transfer belt 22 is exchanged, the intermediate transfer belt 22 is loosened by the recession of the positioning roll 112 or the contact state between the intermediate transfer belt 22 and the photoconductor 31 or the primary transfer roll 51 is released. Therefore, with the detectors 303 and 304 remain as are, the intermediate transfer belt 22 is capable of being pulled out in the direction of the rotary shafts of the tension rolls 41 to 45.

In the exemplary embodiment, a transmissive member is used as the encoder disc 301, and interrupters is used as the detectors 303 and 304; however, the exemplary embodiment is not limited thereto, a reflective member may be used as the encoder disc 301, and a reflection sensor may be used as the detectors 303 and 304. Otherwise, another method may be used.

In addition, in the exemplary embodiment, the contact/separation mechanism 110 and the interlocking mechanism 120 are used when loosening the intermediate transfer belt 22; however, it is needless to say that another configuration may be used as a method of loosening the intermediate transfer belt 22.

Comparative Embodiment

Next, for comparison, an example of a case, where phase output at a time point in the past as in the example described above is not used, will be described as a Comparative Embodiment.

Figure 6A:
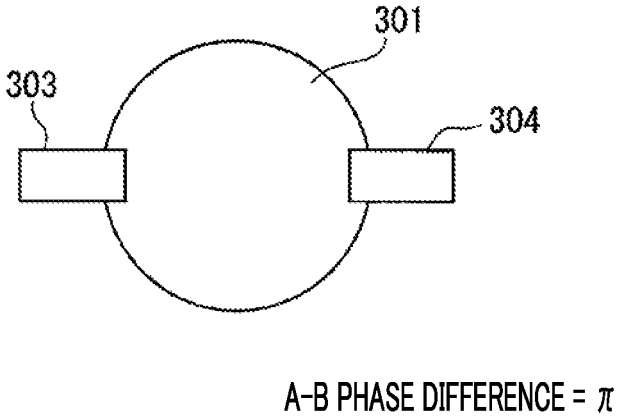
FIG. 6A is a schematic view showing a positional relationship between an encoder disc and a detector in Comparative Embodiment.

In Exemplary Embodiment 1, the detectors 303 and 304 are arranged at a phase of π/2 (90 degrees); however, in Comparative Embodiment, the detectors are arranged (arranged to face each other) at 180 degrees as shown in FIG. 6A, and a method of calculating the rotational error will be described according to the block diagram in FIG. 6B. Note that the same reference signs are assigned to the same configurational elements as in Exemplary Embodiment 1, and thus description thereof is omitted.

In this case, in order to calculate the rotational error, the A-phase output and the B-phase output are added and then the added amount is divided by 2, which is the rotational error to be calculated in the example. At this time, when the detectors 303 and 304 are accurately arranged with a phase difference of 180 degrees, the averaged error can become the true rotational error as is; however, when the detectors are arranged with a phase shift, it is difficult for the true rotational error to be detected.

In the case of a shift from the phase of 180 degrees, a method, in which one detector is delayed by an angle of an attachment error, outputs of the two detectors are synthesized, and thereby the attachment error is removed, is known.

In other words, according to Exemplary Embodiment 1, Comparative Embodiment corresponds to a method in which the error is calculated by using two values of A(tc) and B(tp).

In this condition, in order to calculate an accurate error, there is a need to satisfy a relationship between e(tc)≈≅(tp), that is, the two detectors 303 and 304 are arranged at positions which is shifted in phase very little from the phase of 180 degrees or Comparative Example is applicable only in a case where e(t) is very gradually changed.

Hence, it is understood that computation as in Exemplary Embodiment 1 enables significant flexibility to the phase shift occurring when the two detectors 303 and 304 are attached.

Figure 7:
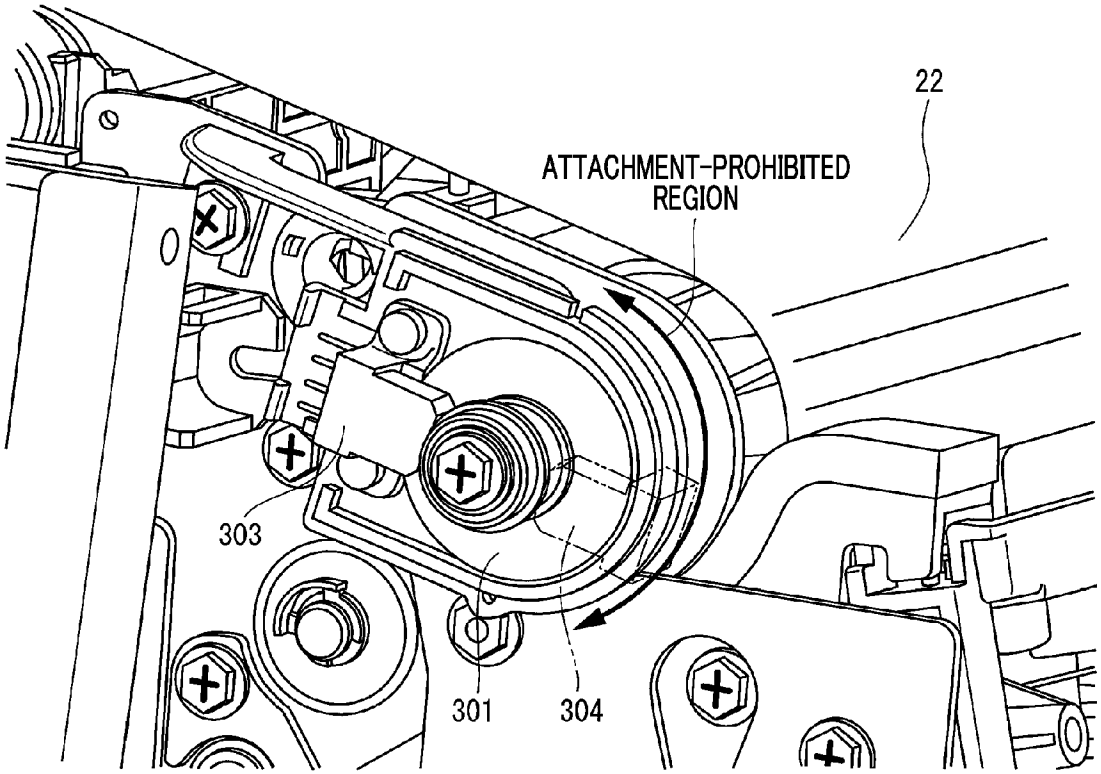
FIG. 7 is a perspective view showing a layout of detectors in Comparative Embodiment.

Further, FIG. 7 is a perspective view showing a layout of detectors in Comparative Embodiment. When the detectors 303 and 304 are arranged in this manner, the detector 304 (drawn in an imaginary line in FIG. 7) interferes with the pulling-out operation of the intermediate transfer belt 22 when the intermediate transfer belt 22 is pulled out from the tension roll 41. As a result, the detector 304 is disposed in an attachment-prohibited region in FIG. 7 when the intermediate transfer belt 22 is pulled out, it is not possible to pull out the intermediate transfer belt 22 with the detector 304 remaining as is. When the intermediate transfer belt 22 is removed after the detector 304 that interferes with the pulling-out operation is removed, and the detector 304 is again attached after the exchange of the intermediate transfer belt 22, it is expected that an attachment position of the detector 304 will be shifted from the first position, and it is difficult to perform accurate rotation control. Otherwise, the same is true of collective removal of the two detectors 303 and 304, and then reattachment thereof.

Accordingly, the two detectors 303 and 304 are arranged as in Exemplary Embodiment 1, then, an exchange operation of the intermediate transfer belt 22 is performed without removal of the two detectors 303 and 304, and then, it is understood that accurate rotation control is maintained.

Exemplary Embodiment 2

Figure 8A:
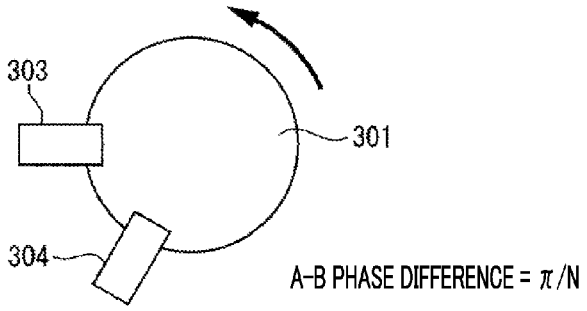
FIG. 8A is a schematic view showing a positional relationship between an encoder disc and detectors in Exemplary Embodiment 2.
Figure 8B:
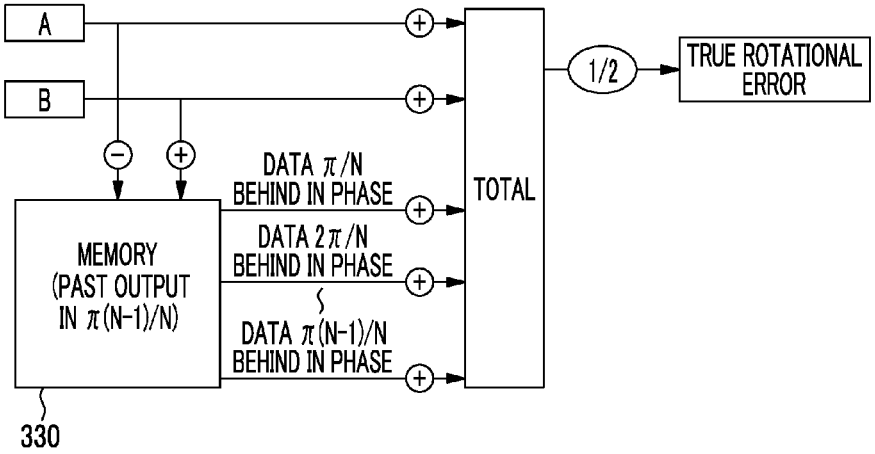
FIG. 8B is a block diagram showing an error calculating method in an offset calculating section.

FIG. 8A is a schematic view showing a positional relationship between the encoder disc 301 and the detectors 303 and 304 in Exemplary Embodiment 2, and FIG. 8B is a block diagram showing an error calculating method in the offset calculating section 310. Note that the same reference signs are assigned to the same configurational elements as in Exemplary Embodiment 1, and thus description thereof is omitted.

In FIGS. 8A and 8B, unlike Exemplary Embodiment 1, the detectors 303 and 304 of the exemplary embodiment are arranged with a difference in a phase of π/N (N is an integer equal to or greater than 2). In addition, the offset calculating section 310 performs computation shown in the block diagram using current outputs (current amounts) and (N−1) outputs (past amounts) in the past which are shifted in phase by π/N to (N−1)π/N and which are stored in the memory 330, with respect to the output from the detector 303 side (A-phase output) and the output from the detector 304 side (B-phase output).

In other words, a sum of a difference obtained by subtracting the A-phase output from the B-phase output in the past outputs shifted by π/N, differences obtained by subtracting the A-phase outputs from the B-phase outputs in the (N−1) past outputs which are up to the (N−1)π/N shift at intervals of π/N, the current A-phase output, and the current B-phase output is obtained, and then the sum is divided by 2, thereby calculating the true rotational error. This is construed by the following expressions.

Here, when

N: natural number equal to or greater than 2

π/N: difference in phase of detector

A(t): A-phase output

B(t): B-phase output t[0]: current time point t [n]: time point (nπ)/N behind in phase (here, n=1 to N−1)

ω: angular velocity e(t): true error, $$A(t[0])=e(t[0])+\sin(\omega t[0]) \quad (1)$$

$$B(t[0])=e(t[0])+\sin(\omega t[0]-\pi/N) \quad (2)$$

$$A(t[n])=e(t[n])+\sin(\omega t[n]) \quad (3)$$

$$B(t[n])=e(t[n])+\sin(\omega t[n]-\pi/N) \quad (4).$$

Here, $$t[n]=t[0]-(n\pi)/(N\omega) \quad (5).$$

Here, when addition and subtraction is performed as shown in the block diagram, the following result is obtained.

$$\begin{aligned}
&\left\{A(t[0])+B(t[0])+\sum[n=1 \text{ to } N-1]\{-A(t[n])+B(t[n])\}\right\}/2= \\
&\quad \{e(t[0])+\sin(\omega t[0])+e(t[0])+\sin(\omega t[0]-\pi/N)+ \\
&\quad \sum[n=1 \text{ to } N-1]\{-e(t[n])-\sin(\omega t[0]-(n\pi)/N)+ \\
&\quad e(t[n])+\sin(\omega t[0]-((n+1)\pi)/N)\}/2= \\
&\quad \{e(t[0])+\sin(\omega t[0])+e(t[0])+\sin(\omega t[0]-(n\pi)/N)- \\
&\quad \sin(\omega t[0]-\pi/N)+\sin(\omega t[0]-\pi)\}/2=e(t[0])
\end{aligned}$$

As a result, only the true rotational error at the current time point t[0] is calculated.

Here, a case of N=3 means a case where the two detectors 303 and 304 are arranged at a phase of π/3 (60 degrees).

Figure 9A:
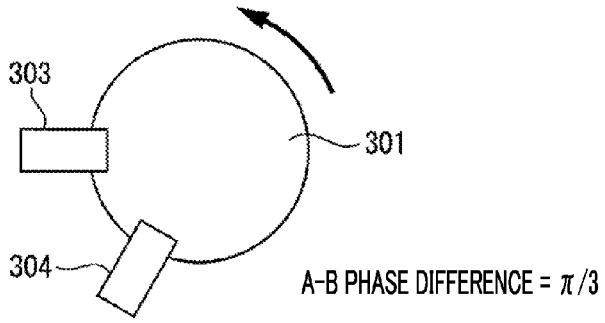
FIG. 9A is a schematic view showing a positional relationship between the encoder disc and the detector.
Figure 9B:
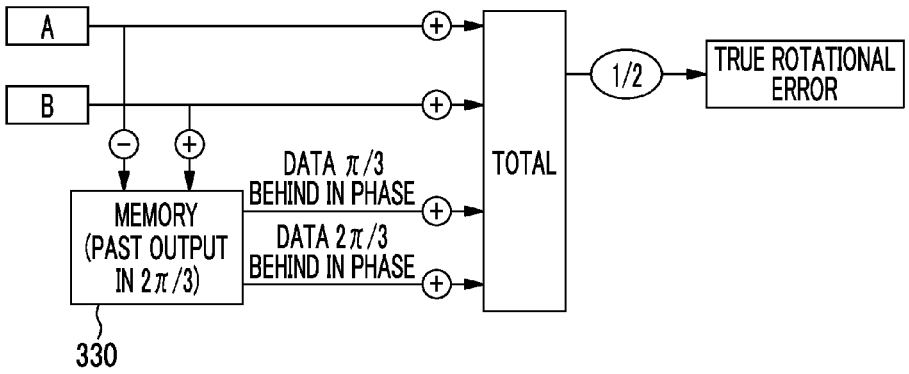
FIG. 9B is a block diagram showing an error calculating method in an offset calculating section, when N is 3 in Exemplary Embodiment 2.
Figure 10:
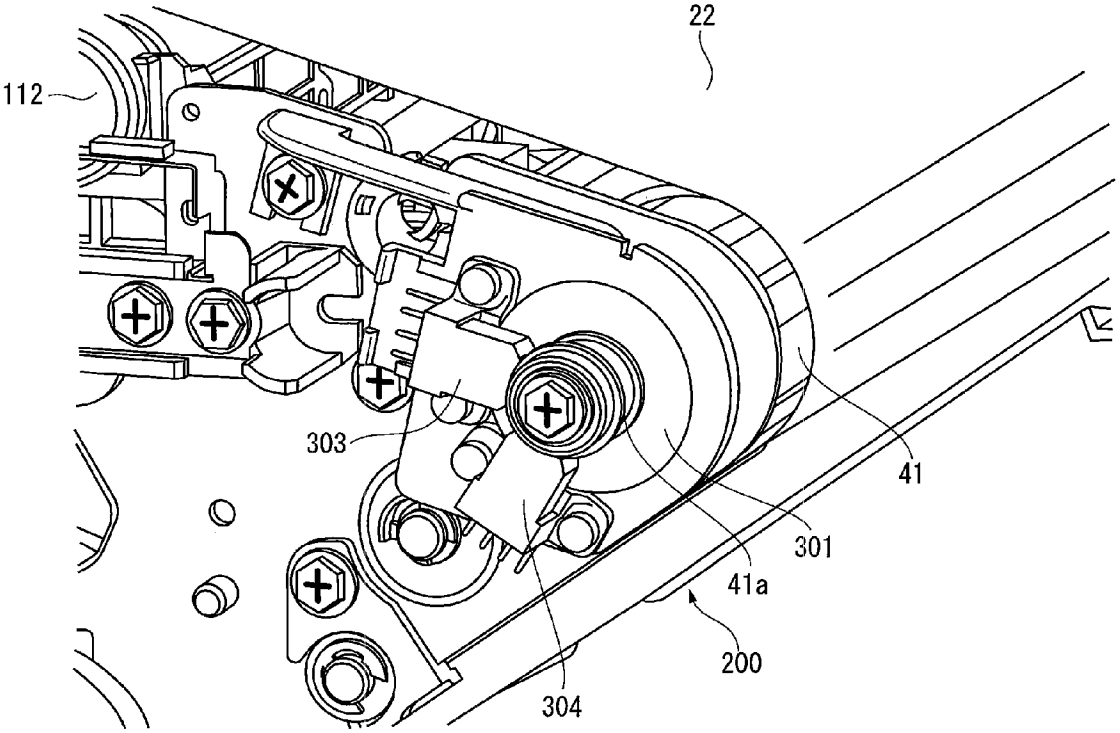
FIG. 10 is a perspective view showing a positional relationship between an intermediate transfer belt and a detector in Exemplary Embodiment 2.

FIGS. 9A and 9B show a case in which N is 3 (a difference in a phase of π/3) as an example of Exemplary Embodiment 2: FIG. 9A is a schematic view showing a positional relationship between the encoder disc 301 and the detectors 303 and 304; and FIG. 9B is a block diagram showing an error calculating method in the offset calculating section 310. Further, FIG. 10 is a perspective view showing a positional relationship between the intermediate transfer belt 22 and the two detectors 303 and 304 at that time. The exemplary embodiment is different from Exemplary Embodiment 1 in that the two detectors 303 and 304 are arranged at a phase of π/3 (60 degrees).

In FIGS. 9A and 9B, the offset calculating section 310 in the exemplary embodiment performs computation shown in the block diagram using current outputs (current amounts) and past outputs (past amounts), which are shifted in phase by π/3 and 2π/3 and which are stored in the memory 330, with respect to the output from the detector 303 side (A-phase output) and the output from the detector 304 side (B-phase output). In other words, a sum of a difference obtained by subtracting the A-phase output from the B-phase output in the past outputs shifted by π/3, a difference obtained by subtracting an A-phase output from a B-phase output in the past output shifted by 2π/3, the current A-phase output, the B-phase output is obtained, and then the sum is divided by 2, thereby calculating the true rotational error.

This is obtained by substituting N with 3 in the expressions (equations) described above; however, in this case, it is also needless to say that the true rotational error is calculated.

Here, in the exemplary embodiment, the two detectors 303 and 304 are arranged at a phase of π/3 (60 degrees); however, in this case, as shown in FIG. 10, when the intermediate transfer belt 22 side is viewed in a direction parallel to the axial direction of the tension roll 41, the two detectors 303 and 304 can be easily arranged within a range inside the circular track of the intermediate transfer belt 22. Therefore, the removal operation of the intermediate transfer belt 22 is easily performed. It is needless to say that the computation processing is slightly complicated more than in the case of Exemplary Embodiment 1.

As an example of Exemplary Embodiment 2, the two detectors 303 and 304 are arranged at a phase of π/3 (60 degrees); however, as shown in the expressions, the two detectors 303 and 304 may be arranged so as to have a phasic relationship of (π/N) other than π/3. Then, it is not denied that the computation performed when the true rotational error is calculated is more complicated as the two detectors 303 and 304 are arranged so as to have a smaller phase. Accordingly, it is preferable that the two detectors 303 and 304 are arranged at the phase of π/2 (90 degrees), or at the phase of π/3 (60 degrees).

EXAMPLE

Example 1

Figure 11A:
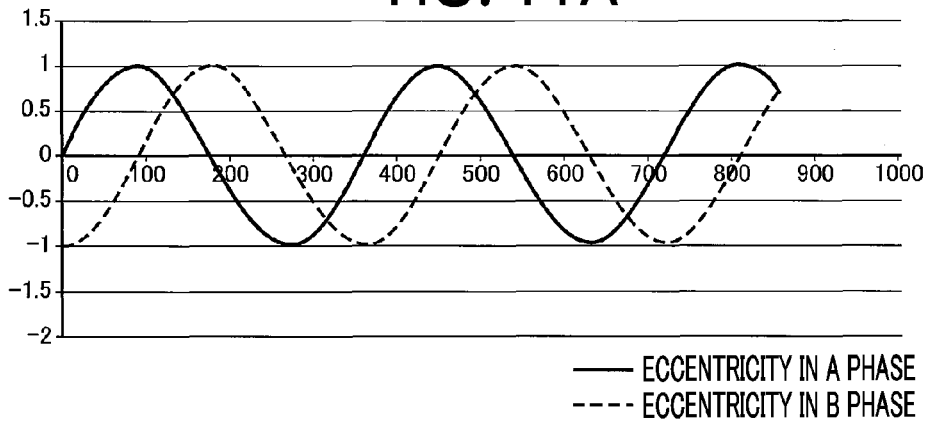
FIGS. 11A to 11C are graphs obtained in Example 1.
Figure 11B:
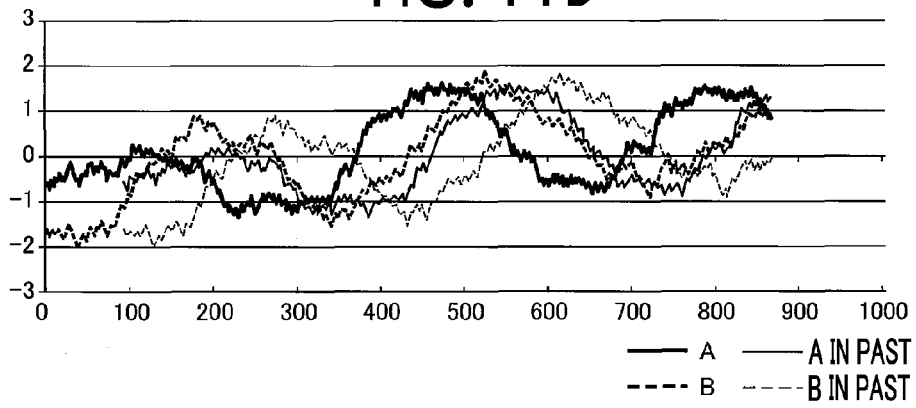
Figure 11C:
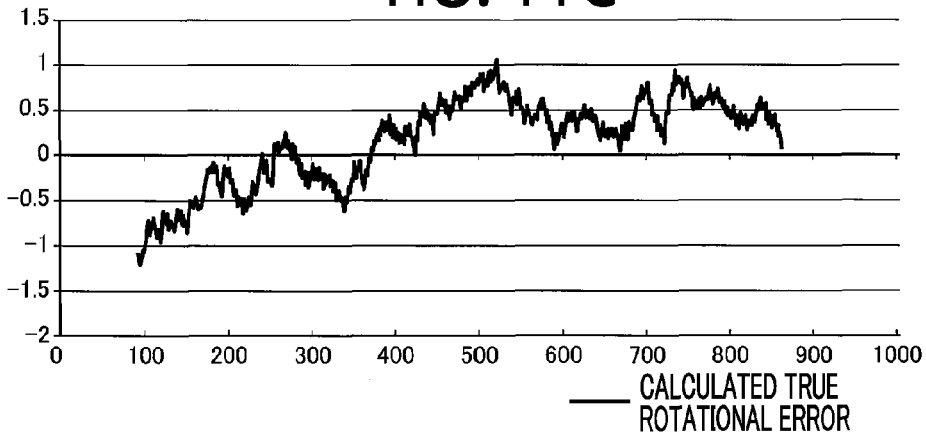

FIGS. 11A to 11C are graphs of calculating the rotational error when the two detectors are arranged at a phase of π/2 (90 degrees) with respect to the encoder disc.

FIG. 11A shows that the B phase is more delayed than the A phase by a phase of π/2 and FIG. 11B shows output waveforms obtained by the two detectors, and shows waveforms of the A phase and the B phase at the current time point and a waveform $\pi/2$ behind in phase (described as past).

As a result of computation shown in the block diagram in FIG. 5B with respect to the graphs, the true rotational error as shown in FIG. 11C is calculated.

Example 2

Figure 12A:
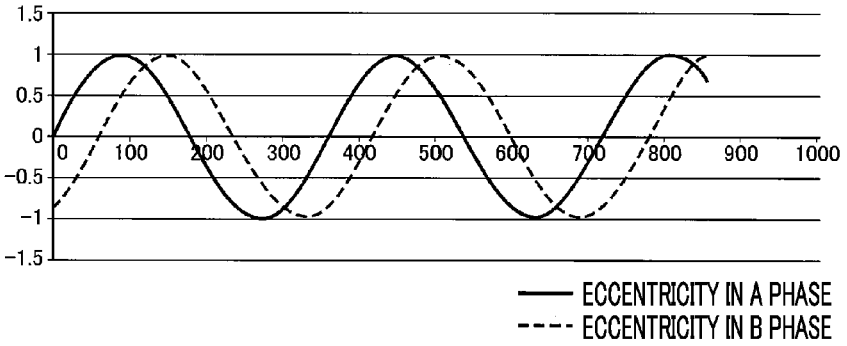
FIGS. 12A to 12C are graphs obtained in Example 2.
Figure 12B:
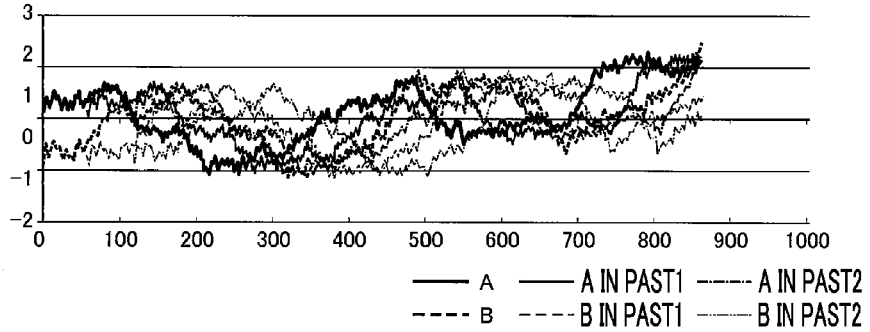
Figure 12C:
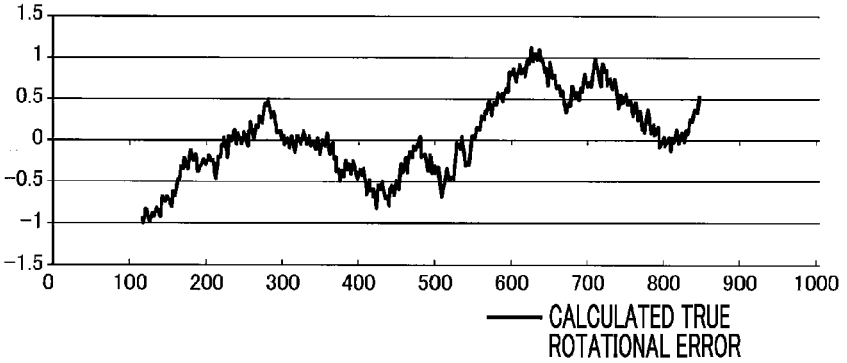

FIGS. 12A to 12C are graphs of calculating the rotational error when the two detectors are arranged at a phase of $\pi/3$ (60 degrees) with respect to the encoder disc.

FIG. 12A shows that the B phase is more delayed than the A phase by a phase of $\pi/3$ and FIG. 12B shows output waveforms obtained by the two detectors, and shows waveforms of the A phase and the B phase at the current time point, a waveform $\pi/3$ behind in phase (described as past 1), and a waveform $2\pi/3$ behind in phase (described as past 2).

As a result of computation shown in the block diagram in FIG. 9B with respect to the graphs, the true rotational error as shown in FIG. 12C is calculated.

Comparative Example

Figure 13A:
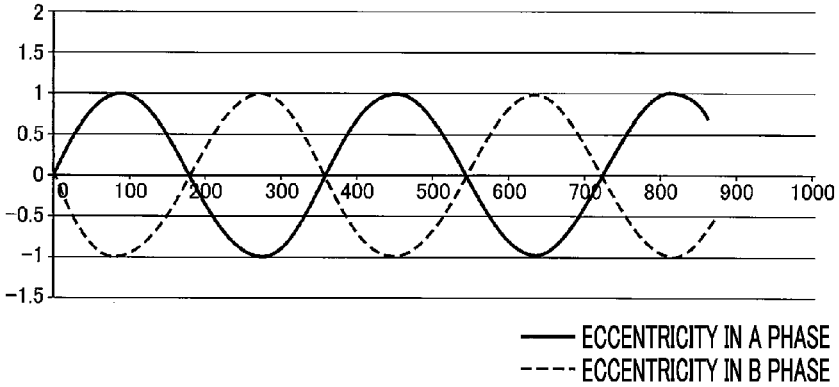
FIGS. 13A to 13C are graphs obtained in Comparative Example.
Figure 13B:
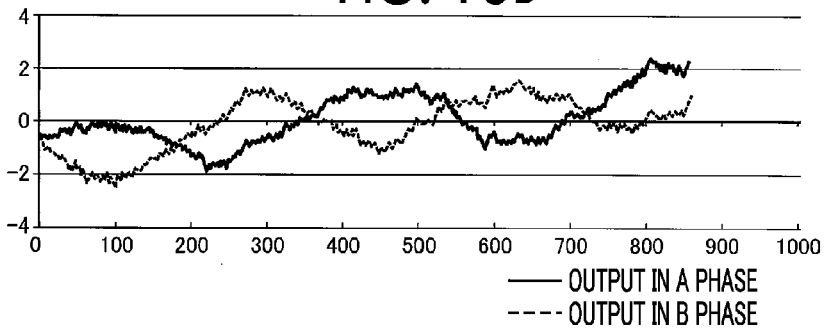
Figure 13C:
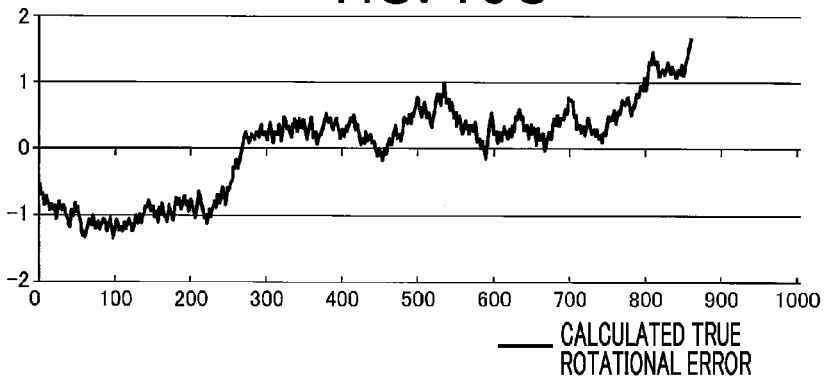

FIGS. 13A to 13C are graphs of calculating the rotational error when the two detectors are arranged at a phase of $\pi$ (180 degrees) with respect to the encoder disc.

FIG. 13A shows that the B phase is more delayed than the A phase by a phase of $\pi$ and FIG. 13B shows output waveforms obtained by the two detectors, and shows waveforms of the A phase and the B phase at the current time point.

Figure 6B:
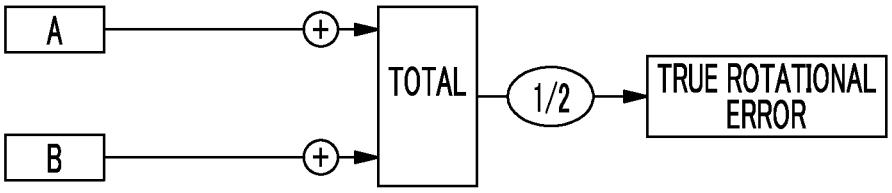
FIG. 6B is a block diagram showing an error calculating method in an offset calculating section.

As a result of computation shown in the block diagram in FIG. 6B with respect to the graphs, the true rotational error as shown in FIG. 13C is calculated.

In other words, also in the Comparative Example, it is possible to calculate the true rotational error; however, it is needless to say that whether the calculated value is an actual rotational error depends on an actual arrangement of the detectors or the like, as shown in Comparative Embodiment described above.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A rotation-information detecting device comprising:

a rotatable rotary member comprising a plurality of detection targets arranged at predetermined intervals over an entire circumference of the rotary member in a circumferential direction;

two detectors that are fixedly arranged at two positions of the rotary member in a rotating direction of the detection targets, and are configured to detect the detection targets that are rotating; and a computation unit configured to compute rotation information of the rotary member using detection information from the two detectors, wherein N is an integer equal to or greater than 2, and n is an integer of 1 to (N−1), wherein the two detectors are arranged along the circumferential direction of the rotary member at an interval of an angle of $\pi/N$, wherein the computation unit includes an offset calculating section configured to offset an eccentric error of the rotary member using outputs of the two detectors at a current time point and n outputs at time points before the current time point by phases of $(n\pi)/N$, to calculate a true rotational error, and wherein the two detectors are arranged at positions at which the detectors do not interfere with a pulling-out operation of an endless belt member of a toner holding member of an image forming apparatus comprising the rotation-information detecting device.

2. The rotation-information detecting device according to claim 1, wherein one of the two detectors disposed on an upstream side in the rotating direction of the rotary member in a range where an angle formed between the two detectors is equal to or less than $\pi/2$ is referred to as an upstream-side detector, and the other of the two detectors disposed on a downstream side is referred to as a downstream-side detector, and wherein the offset calculating section is configured to calculate the true rotational error as a value obtained by dividing, by 2, a sum of a total obtained by adding outputs of the upstream-side detector and the downstream-side detector at the current time point and a total of n differences obtained by subtracting outputs of the upstream-side detector from outputs of the downstream-side detector at time points before the current time point by phases of $(n\pi)/N$.

3. The rotation-information detecting device according to claim 1, wherein the two detectors are arranged so as to have an angle of $\pi/2$ or $\pi/3$ therebetween.

4. The rotation-information detecting device according to claim 2, wherein the two detectors are arranged so as to have an angle of $\pi/2$ or $\pi/3$ therebetween.

5. A rotation control device comprising:

a rotatable rotary body;

a rotation drive unit configured to drive rotation of the rotary body;

the rotation-information detecting device of claim 1; and a rotation control unit configured to control the rotation drive unit such that the true rotational error is reduced, using the true rotational error calculated by the rotation-information detecting device.

6. A rotation control device comprising:

a rotatable rotary body;

a rotation drive unit configured to drive rotation of the rotary body;

the rotation-information detecting device of claim 2; and a rotation control unit configured to control the rotation drive unit such that the true rotational error is reduced, using the true rotational error calculated by the rotation-information detecting device.

7. A rotation control device comprising:

a rotatable rotary body;

a rotation drive unit configured to drive rotation of the rotary body;

the rotation-information detecting device of claim 3; and a rotation control unit configured to control the rotation drive unit such that the true rotational error is reduced, using the true rotational error calculated by the rotation-information detecting device.

8. A rotation control device comprising:

a rotatable rotary body;

a rotation drive unit configured to drive rotation of the rotary body;

the rotation-information detecting device of claim 4; and a rotation control unit configured to control the rotation drive unit such that the true rotational error is reduced, using the true rotational error calculated by the rotation-information detecting device.

9. An image forming apparatus comprising:

a toner holding member configured to hold a toner image and configured to rotate;

an image forming unit configured to form a toner image on the toner holding member; and the rotation control device according to claim 5 that is configured to control the rotation of the toner holding member.

10. An image forming apparatus comprising:

a toner holding member configured to hold a toner image and configured to rotate;

an image forming unit configured to form a toner image on the toner holding member; and the rotation control device according to claim 6 that is configured to control the rotation of the toner holding member.

11. An image forming apparatus comprising:

a toner holding member configured to hold a toner image and configured to rotate;

an image forming unit configured to form a toner image on the toner holding member; and the rotation control device according to claim 7 that is configured to control the rotation of the toner holding member.

12. An image forming apparatus comprising:

a toner holding member configured to hold a toner image and configured to rotate;

an image forming unit configured to hold a toner image on the toner holding member; and the rotation control device according to claim 8 configured to control the rotation of the toner holding member.

13. The image forming apparatus according to claim 9, wherein the toner holding member includes:

a plurality of tension rolls that are configured to rotate by being supported on a support member, and an endless belt member that is stretched over the plurality of tension rolls and is capable of being pulled out from the plurality of tension rolls in a direction of a rotary shaft of the corresponding tension roll, wherein the rotation control device is configured to control rotation of at least one of the plurality of tension rolls, and wherein the two detectors are arranged at positions at which the detectors do not interfere with a pulling-out operation of the endless belt member.

14. The image forming apparatus according to claim 10, wherein the toner holding member includes:

a plurality of tension rolls that are configured to rotate by being supported on a support member, and an endless belt member that is stretched over the plurality of tension rolls and is capable of being pulled out from the plurality of tension rolls in a direction of a rotary shaft of the corresponding tension roll, wherein the rotation control device is configured to control rotation of at least one of the plurality of tension rolls, and wherein the two detectors are arranged at positions at which the detectors do not interfere with a pulling-out operation of the endless belt member.

15. The image forming apparatus according to claim 11, wherein the toner holding member includes:

a plurality of tension rolls that are configured to by being supported on a support member, and an endless belt member that is stretched over the plurality of tension rolls and is capable of being pulled out from the plurality of tension rolls in a direction of a rotary shaft of the corresponding tension roll, wherein the rotation control device configured to control rotation of at least one of the plurality of tension rolls, and wherein the two detectors are arranged at positions at which the detectors do not interfere with a pulling-out operation of the endless belt member.

16. The image forming apparatus according to claim 12, wherein the toner holding member includes:

a plurality of tension rolls that are configured to rotate by being supported on a support member, and an endless belt member that is stretched over the plurality of tension rolls and is capable of being pulled out from the plurality of tension rolls in a direction of a rotary shaft of the corresponding tension roll, wherein the rotation control device is configured to control rotation of at least one of the plurality of tension rolls, and wherein the two detectors are arranged at positions at which the detectors do not interfere with a pulling-out operation of the endless belt member.

17. An image forming apparatus comprising:

an image forming unit configured to form a toner image;

a plurality of tension rolls that are configured to rotate by being supported on a support member;

an endless belt member that is stretched over the plurality of tension rolls and is capable of being pulled out from the plurality of tension rolls in a direction of a rotary shaft of the corresponding tension roll; and a rotation-information detecting device that is attached to a rotary shaft of at least one the plurality of tension rolls and is configured to detect rotation information of the rotary shaft, wherein the rotation-information detecting device includes:

a rotatable rotary member comprising a plurality of detection targets arranged at predetermined intervals over an entire circumference of the rotary member in a circumferential direction, and two detectors that are fixedly arranged at two positions along a rotating direction of the detection targets of the rotary member, and are configured to detect the detection targets which are rotating, and wherein the two detectors have an angle of $\pi/2$ or smaller therebetween and are arranged at positions at which the detectors do not interfere with a pulling-out operation of the endless belt member.

18. The rotation-information detecting device according to claim 1, wherein the offset calculating section is configured to offset the eccentric error of the rotary member using the outputs of the two detectors to calculate the true rotational error and without using any outputs from any other detectors that are fixedly arranged at the rotary member and that are configured to detect the detection targets that are rotating.

* * * * *